US008308836B2

(12) United States Patent
Liu et al.

(10) Patent No.: US 8,308,836 B2
(45) **Date of Patent: *Nov. 13, 2012**

(54) CONTINUOUS COARSE ASH DEPRESSURIZATION SYSTEM

(75) Inventors: Guohai Liu, Birmingham, AL (US); Wan Wang Peng, Birmingham, AL (US); Pannalal Vimalchand, Birmingham, AL (US)

(73) Assignee: Southern Company, Birmingham, AL (US)

( * ) Notice: Subject to any disclaimer, the term of this patent is extended or adjusted under 35 U.S.C. 154(b) by 877 days.

This patent is subject to a terminal disclaimer.

(21) Appl. No.: 12/426,700

(22) Filed: Apr. 20, 2009

(65) Prior Publication Data

US 2010/0266460 A1 Oct. 21, 2010

(51) Int. Cl.
*B01D 46/30* (2006.01)

(52) U.S. Cl. ..... 55/517; 55/315.1; 55/319; 55/516; 422/145

(58) Field of Classification Search ..... 55/474, 55/512, 513, 514, 516, 517, 518, 519, 315.1, 55/319; 95/276; 422/145
See application file for complete search history.

(56) References Cited

U.S. PATENT DOCUMENTS

| | | | | |
|---|---|---|---|---|
| 4,709,663 | A | 12/1987 | Larson et al. | |
| 4,864,969 | A | 9/1989 | McDonald et al. | |
| 5,054,435 | A | 10/1991 | Wiehn et al. | |
| 8,066,789 | B2 * | 11/2011 | Liu et al. | 55/474 |
| 2004/0100902 | A1 | 5/2004 | Vimalchand et al. | |

OTHER PUBLICATIONS

International Search Report for PCT/US2009/002829, mailed May 13, 2010.*
Written Opinion of the International Searching Authority for PCT/US2009/002829, mailed May 13, 2010.*
International Search Report and Written Opinion issued by the Korean Intellectual Property Office dated May 13, 2010 for related PCT Application No. PCT/US2009/002829.

* cited by examiner

*Primary Examiner* — Robert Clemente
(74) *Attorney, Agent, or Firm* — Ryan A. Schneider, Esq.; Troutman Sanders LLP

(57) ABSTRACT

A system for depressurizing and cooling a high pressure, high temperature dense phase solids stream having coarse solid particles with entrained gas therein. In one aspect, the system has an apparatus for at least partially depressurizing and cooling the high pressure, high temperature dense phase solids stream having gas entrained therein and a pressure let-down device for further depressurization and separating cooled coarse solid particles from a portion of the entrained gas, resulting in a lower temperature, lower pressure outlet of solid particles for downstream processing or discharge to a storage silo for future use and/or disposal. There are no moving parts in the flow path of the solids stream in the system.

29 Claims, 7 Drawing Sheets

CONTINUOUS COARSE ASH DEPRESSURIZATION SYSTEM

ACKNOWLEDGMENT

This invention was made with some government support under Cooperative Agreement Number DE-FC21-90MC25140 awarded by the United States Department of Energy. The United States government has certain rights in the invention.

FIELD OF THE INVENTION

This invention relates generally to discharge from fluidized bed combustion or gasification systems. Specifically, the invention relates to the cooling and depressurization of coarse solid particles from high pressure and high temperature fluidized bed combustion or gasification systems.

BACKGROUND OF THE INVENTION

Operating a pressurized reactor such as a fluidized bed coal gasifier or combustor involves discharging coarse solid particles under high pressure and temperatures to storage bins under atmospheric pressure and low temperature (i.e., below 350° F.). The most commonly used method in such systems is a combination of a lock vessel and a screw cooler system. The screw cooler receives solids under high pressure and temperature and cools the solids by contacting them with the screw and the inner surface of the container.

In this system, the lock vessel is a pressure swing vessel and has inlet and outlet valves. The lock vessel receives the cooled solids under pressure from the screw cooler through a normally open inlet valve. When the predetermined amount of solids enters the lock vessel, the inlet valve is closed. Then, the vessel is depressurized to almost atmospheric pressure. The bottom discharge valve is then opened to discharge the solids to an atmospheric vessel. The solids in the atmospheric vessel can be disposed to proper storage vessels.

There are disadvantages to this system. One inherent disadvantage of this system is the number of moving parts which need to cycle often and operate in a synchronous manner. A second disadvantage is the difficulty in sealing the two ends of the shaft of the screw when the shaft is rotating under high pressure. Additionally, there are a number of valves around the lock vessel, and the reliability of these valves can be less than desired because during each cycle, the valves must open and close in dusty environment. In normal operating conditions, the valves open and close millions of times under high pressure with a rapid flow of solid particles, thereby eroding the valves. Thus, conventional commercially available systems can have availabilities on average of less than 70%.

What is needed then is a system for cooling and continuously depressurizing the coarse solid particles without the inherent issues mentioned above.

SUMMARY OF THE INVENTION

The invention relates to a depressurization system in fluid communication with a high pressure, high temperature dense phase solids stream with entrained gas, such as, for example and without limitation, a coarser ash stream from a fluidized bed gasification system. In one aspect, the system comprises an apparatus for cooling the high pressure, high temperature dense phase solids stream with entrained gas and a pressure letdown device (i.e., a separator) for separating the cooled coarse solid particles from a portion of the entrained gas in order to reduce the stream pressure to a desired exit discharge pressure.

In one aspect, the pressure letdown device has a housing defining an interior separator cavity and having a housing wall and a filter within the interior separator cavity. In another aspect, the filter has an inner wall and a spaced outer wall, the outer wall being spaced therefrom the housing wall and defining an enclosed annulus between the filter and the housing wall. In this aspect, the inner wall defines a filter conduit in fluid communication with the high pressure, lower temperature solids stream with entrained gas. The filter is configured to allow at least a portion of the cooled coarse solid particles to pass therethrough the filter conduit and exit via a solids outlet positioned adjacent a distal end of the filter conduit, while at least a portion of the entrained gas is directed to the gas outlet, which results in a lower pressure outlet for the cooled coarse solid particles.

In one aspect, the depressurization system further comprises a moving packed bed of a solids stream entrained with gas in a horizontal or vertical column in which the gas is flowing faster than the solids to induce pressure reduction. Friction between the coarse particles and an inner wall of the column, and the speed of the gas in the column can substantially reduce the amount of gas to be separated from the solids in the pressure letdown device. In another aspect, the horizontal or vertical column can also be configured as a heat exchanger to provide at least a portion of the cooling to lower the temperature of the high pressure, high temperature dense phase solids stream with entrained gas.

In another aspect, no moving parts, such as for example and without limitation, a valve, are in the flow path of the solids stream, thereby improving the reliability of the depressurization system.

BRIEF DESCRIPTION OF THE DRAWINGS

These and other features of the preferred embodiments of the invention will become more apparent in the detailed description in which reference is made to the appended drawings wherein.

DETAILED DESCRIPTION OF THE INVENTION

Figure 1:
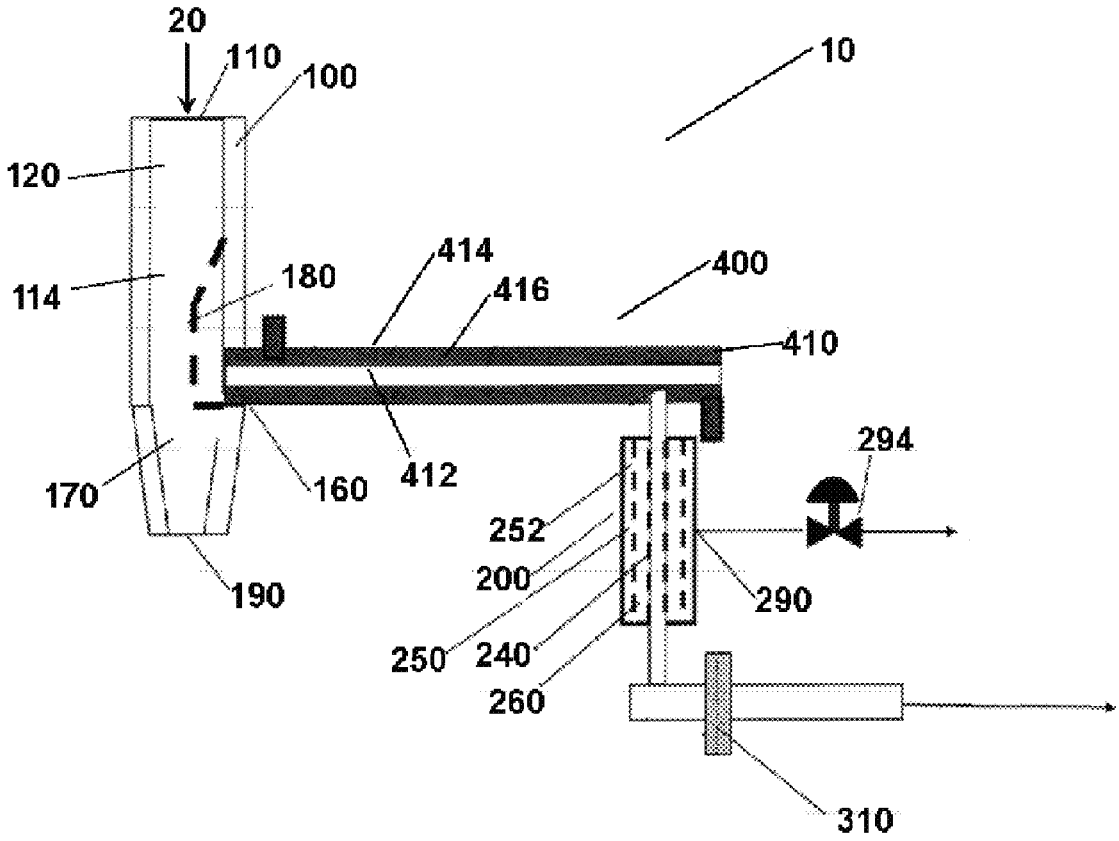
FIG. 1 is a schematic view of one embodiment of a depressurization system of the current application.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a valve" can include two or more such valves unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the term "high pressure" means a pressure at about 30 psig or above.

As used herein, the term "high temperature" means a temperature at about 500 degrees Fahrenheit or above.

The term "fine particles" means particles having a mean diameter less than or equal to 40 microns or below. The term "coarse particles" refers to particles having a mean diameter greater than 40 microns.

The invention relates to a depressurization system 10 that is in fluid communication with a high pressure, high temperature dense phase solids stream having gas entrained therein by coarser particles. The system is for use, for example, in processes that have particulate matter that needs to be cooled and depressurized prior to further processing or disposal of the particulate matter. In one exemplary embodiment, the system is intended for use in gasification processes, because, for example, the discharge of solids directly from an operating system to an atmospheric storage unit is not desired.

Figure 7:
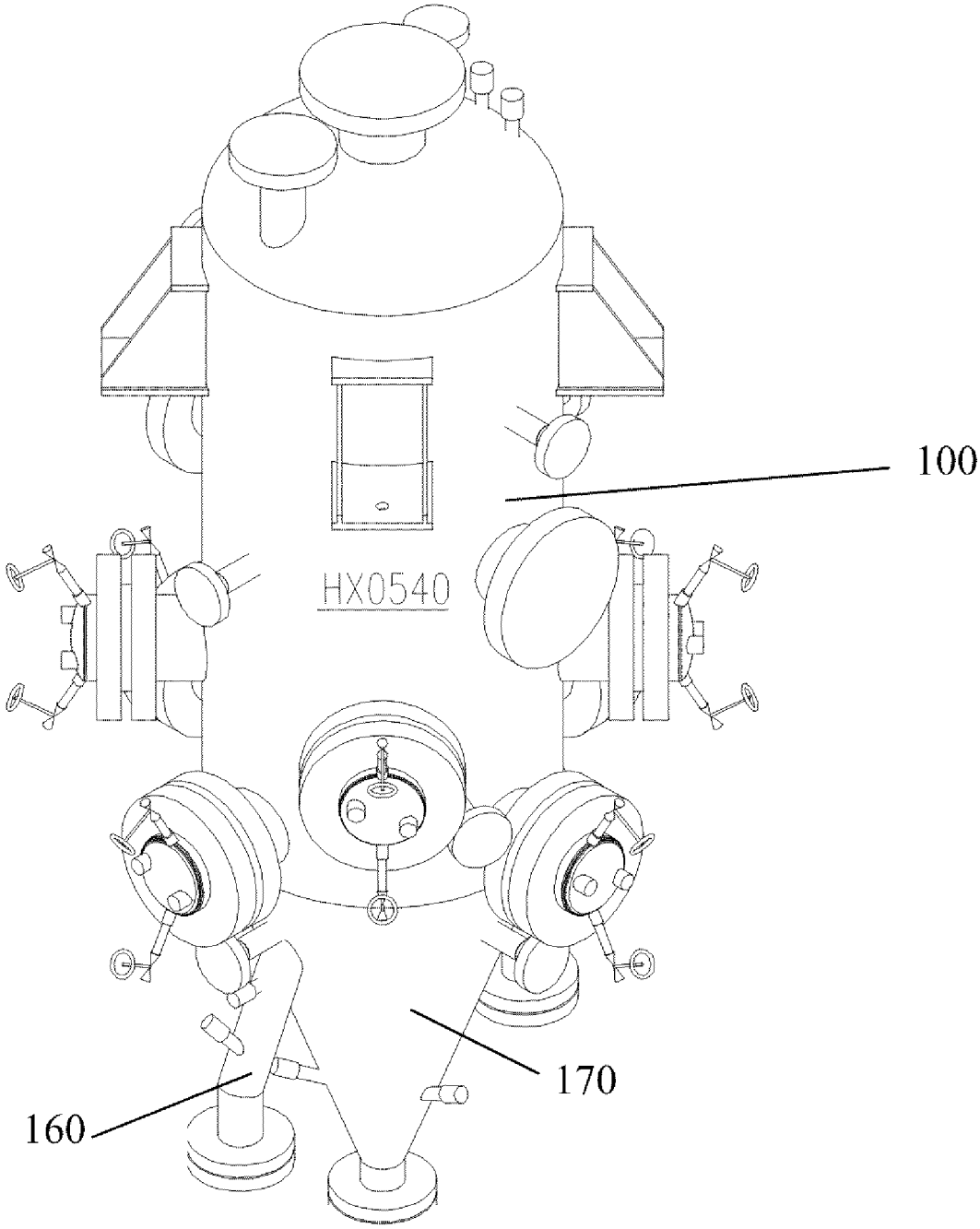
FIG. 7 is a perspective view of one embodiment of a cooling vessel of the depressurization system of FIG. 1.

In one aspect, as illustrated in FIGS. 1 and 7, the depressurization system 10 comprises a vessel 100 defining an interior vessel cavity 114. The vessel 100 has a vessel inlet 110 that is in selective fluid communication with the high pressure, high temperature dense phase solids stream having gas entrained therein 20 and an upper portion 120 of the interior vessel cavity 114. Optionally, in one aspect, the vessel inlet 110 comprises a valve configured to isolate the system from the high pressure, high temperature dense phase solids stream having gas entrained therein if such actions are desired. It is understood, however, that the system can operate without the need for a valve at the inlet or an outlet of the system.

Figure 3:
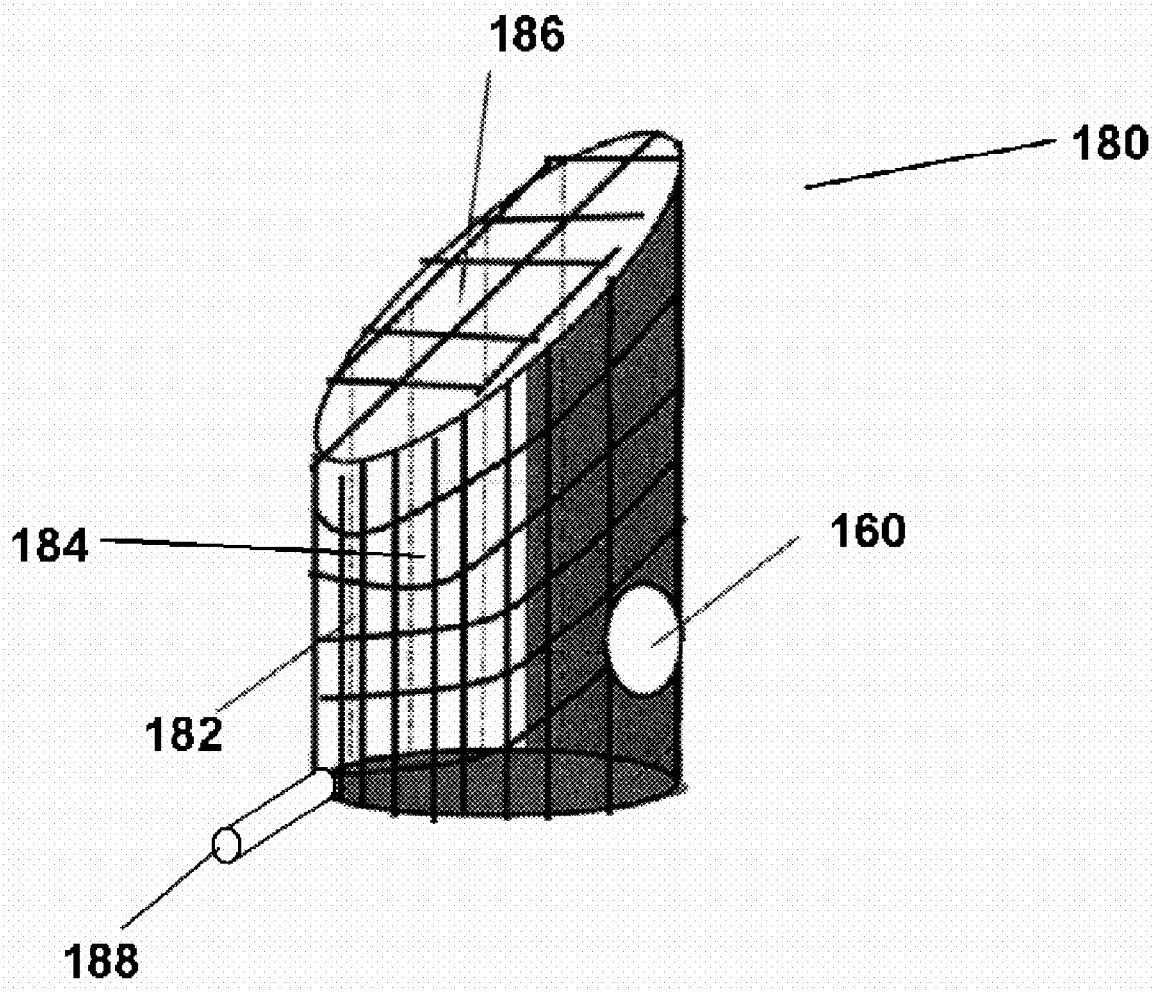
FIG. 3 is a schematic view of a screen according to one aspect.

In another aspect, a vessel outlet 160 is defined therein the vessel 100 that is in fluid communication with a lower portion 170 of the vessel. In another aspect, a screen 180 can be positioned in the vessel cavity 114, substantially enveloping the vessel outlet 160. The screen 180 can be configured, according to one aspect, to block larger extraneous materials from passing through the vessel outlet and potentially blocking the passageways downstream. In one aspect, the screen defines a plurality of screen openings 182, as shown in FIG. 3, that have a dimension equal to a predetermined size, such that any extraneous materials with a dimension larger than that predetermined dimension are prevented from passing through the screen. In one aspect, the predetermined dimension ranges from about 0.1 inches to about 6 inches. In another aspect, the predetermined dimension ranges from about 0.5 inches to about 3 inches. In still another aspect, the predetermined dimension can be sized depending upon the application.

In one aspect, the screen 180 can be shaped to deflect particles having a dimension larger than the predetermined dimension toward the lower portion of the vessel 100. As one can appreciate, the lower portion 170 of the vessel can have appropriate periodic fluidization to sink larger extraneous materials and can be equipped with a particle outlet 190 that is configured to enable an operator to selectively remove the larger particles therefrom the vessel cavity 114 when the system is not in operation. Additionally, in one aspect, a portion of the screen can be spaced therefrom the vessel outlet defining a screen cavity 184 in communication with the vessel outlet 160. In another aspect, a top face 186 of the screen, as illustrated in FIG. 3, can be sloped downwardly away from the wall of the vessel to assist in deflecting the larger particles toward the particle outlet. In still another aspect, at least a portion of the screen cavity 184 can be in fluid communication with a pressurized fluid source 188. For example, a nozzle can be positioned therein the screen cavity that can be activated periodically to inject fluid into the screen cavity, so that larger extraneous material can be urged towards the particle outlet 190 of the vessel. In one exemplary aspect, the pressurized fluid source comprises air. In another exemplary aspect, the pressurized fluid source comprises compressed nitrogen. However, as one skilled in the art can appreciate, other purge gases are also contemplated and the choice of purge gas can be selected based upon, among other things, the gasification application.

The depressurization system 10 can also comprise a cooling apparatus 400, as shown in FIG. 1, to cool the high pressure, high temperature dense phase solids stream entrained with gas to form a high pressure, lower temperature dense phase solids stream entrained with gas 30. In one aspect, the cooling apparatus can be coupled to the vessel outlet 160 and the pressure letdown device 200. In one aspect, the cooling apparatus comprises a thermally conductive elongate cooling conduit 410 in fluid communication with the solids stream. In another aspect, the coarse solid particles entering the cooling apparatus in the solids stream have a dimension smaller than the predetermined dimension of the screen openings 182. At least a portion of the cooling conduit 410 can be in thermal communication with a coolant source. In another aspect, the cooling conduit comprises an inner pipe 412 and a spaced outer pipe 414 defining a coolant pathway 416 therebetween. The coolant pathway provides space for coolant to flow and conducts heat away from the inner pipe 412 and, thus, the solids stream within the conduit. In one aspect, the coolant can be a conventional coolant, such as but not limited to water, $CO_2$, ethylene glycol, and the like. In another aspect, the cooling apparatus can be any other type of heat exchange device as known in the arts, such as a moving bed heat exchanger and the like.

In one aspect, the cooling apparatus 400 can be installed vertically or horizontally. In another aspect, the elongate cooling conduit 410 can be used as part of the depressurization system 10 to reduce the pressure of the solids stream entrained with gas and to minimize the amount of gas to be vented out through a gas outlet 290 on the pressure letdown device. In this aspect, the elongate cooling conduit can reduce the pressure of the solids stream entrained with gas when positioned vertically, horizontally, or in any other direction, and with or without thermal communication with a coolant source. In another aspect, a moving packed bed column can be formed in the cooling apparatus (for example, inside the inner pipe 412), wherein depressurization occurs as the gas is flowing faster than the solids due to the gas release from the pressure letdown device 200, described more fully below. In one aspect, the higher the pressure of the high pressure, high temperature dense phase solids stream having gas entrained therein, the longer the cooling conduit 410 needs to be for a longer moving packed bed column to increase the pressure drop. In one exemplary aspect, the cooling conduit can be 10 feet long for a 70 micron mean size gasifier ash particle stream at 275 psig pressure; however, as can be appreciated, the length of the conduit can also depend upon the particle size and/or characteristics.

Figure 2:
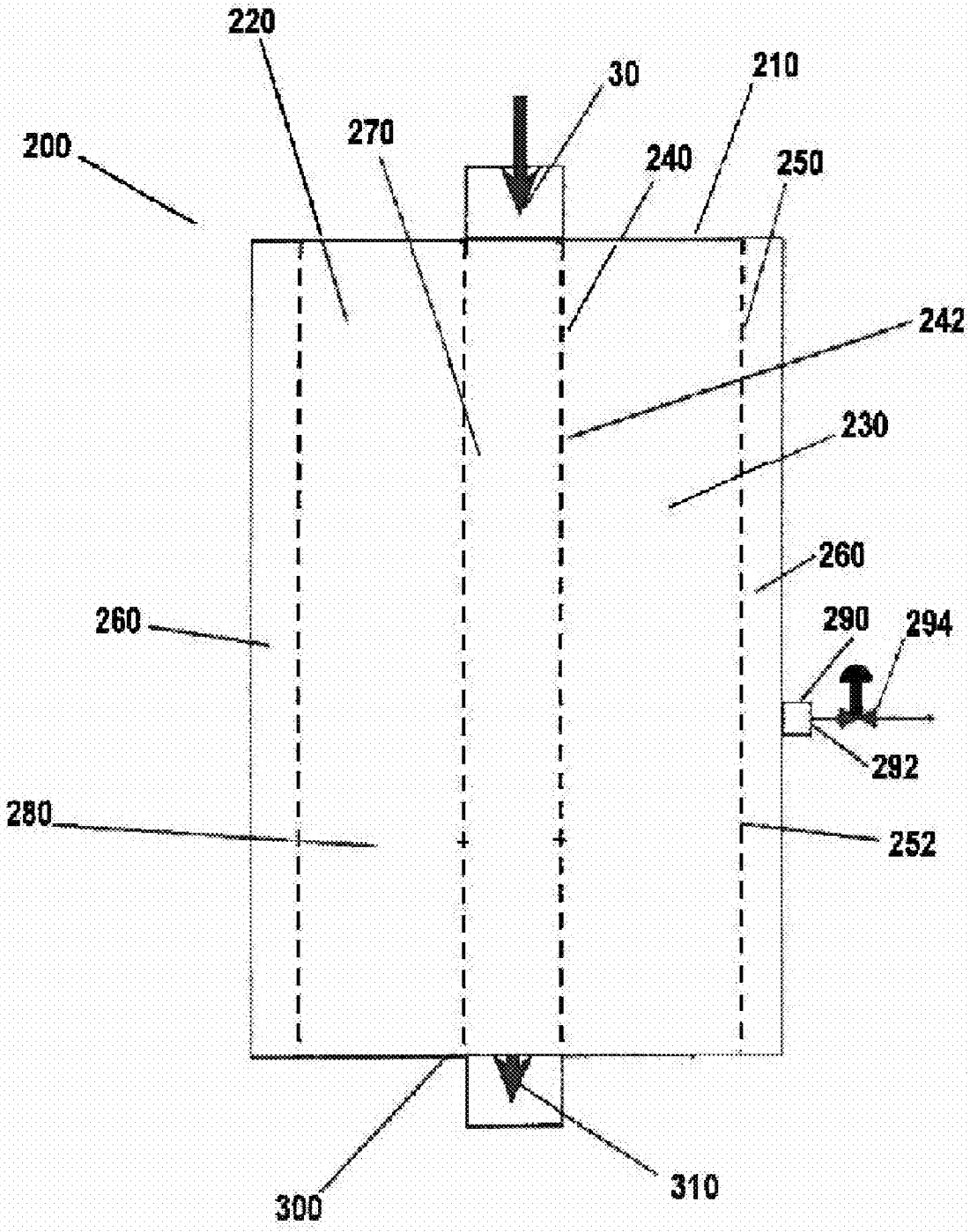
FIG. 2 is a schematic view of one aspect of a pressure letdown device of the depressurization system of FIG. 1.
Figure 5:
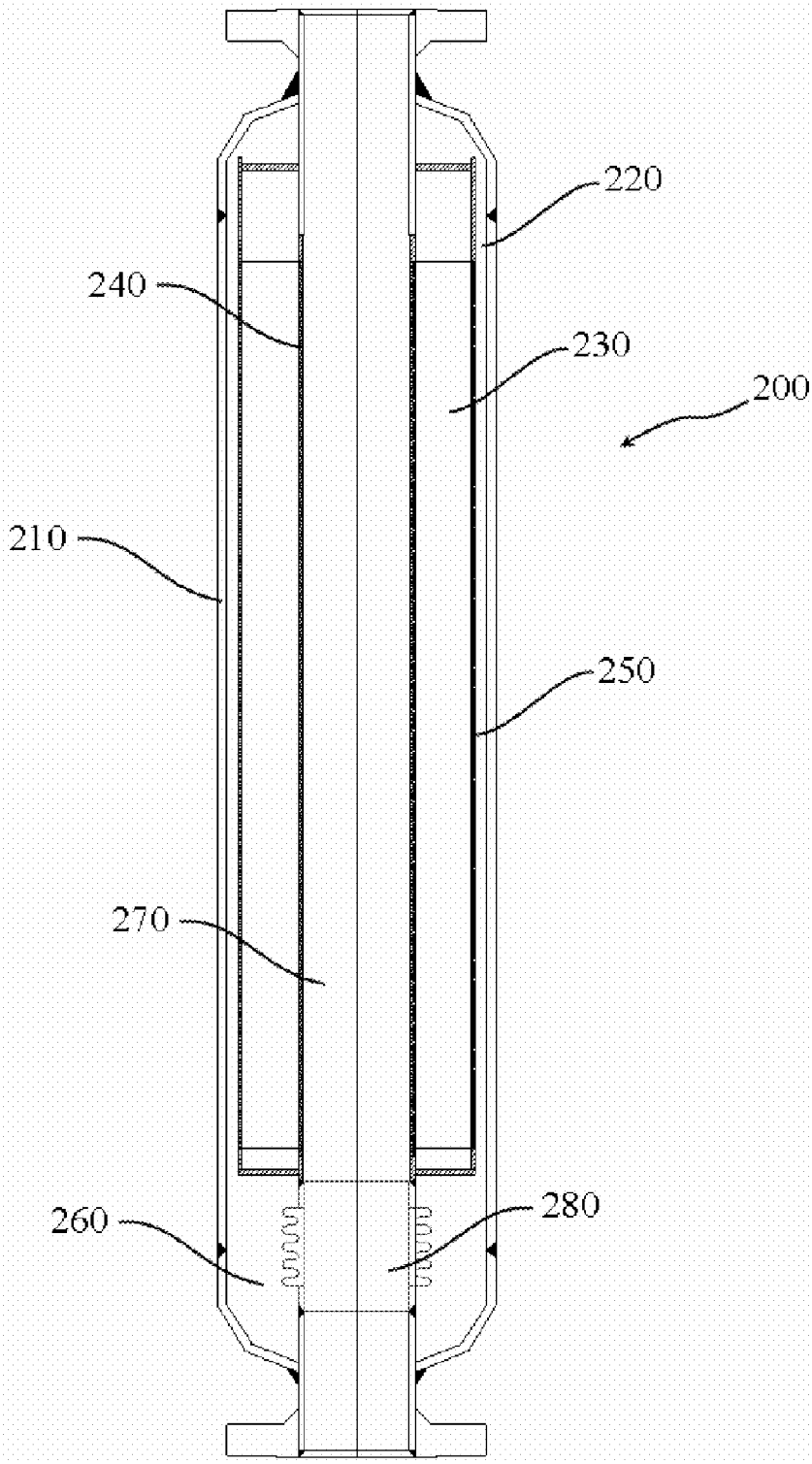
FIG. 5 is a side cross-sectional view of the pressure letdown device of FIG. 2, according to one aspect.

In one aspect, the depressurization system 10 also comprises a pressure letdown device 200 (i.e., a separator), illustrated in FIGS. 2 and 5, configured for separating the cooled coarse solid particles therefrom the high pressure, lower temperature dense phase solids stream entrained with gas 30. The pressure letdown device comprises a housing 210 defining an interior separator cavity 220. In another aspect, disposed within the separator cavity is a filter 230 having an inner wall 240 and a spaced outer wall 250, the outer wall being spaced therefrom a housing wall and defining an enclosed annulus 260 between the filter 230 and the housing wall. The inner wall 240 of the filter defines a filter conduit 270 in fluid communication with the high pressure, lower temperature dense phase solids stream entrained with gas exiting the cooling conduit 410.

In one aspect, the filter 230 comprises a plurality of granular particles with a narrow size distribution to be used as a filter media. In another aspect, the inner wall of the filter comprises a first plurality of pores 242 having a first pore diameter that can be greater than a mean diameter of the coarse solid particles. This first plurality of pores enables the gas, as well as some fine solid particles, to flow therethrough the inner wall 240 of the filter initially to form a cake therein the filter. In another aspect, the outer wall 250 of the filter comprises a second plurality of pores 252 having a second pore diameter that is less than the mean diameter of the plurality of granular particles that are used as filter media in the filter 230. As such, the gas entrained within the dense phase solids stream entrained with gas can pass therethrough, however, any solid particles can be prevented from passing through the granular filter media. In this aspect, the inner wall and the outer wall of the filter define an enclosed filtration cavity 280 within which is disposed the filter media as a bed of granules. In still another aspect, the maximum penetration depth of ash into the granular bed can be predetermined based on the size distribution of the solids stream that is being depressurized. In one aspect, a top portion and a bottom portion of the filter 230 comprise solid plates to enclose the filtration cavity and prevent the escape of gas therethrough.

During operation, in one aspect, after exiting the cooling apparatus, the gas from the high pressure, lower temperature dense phase solids stream entrained with gas 30 flows through the first plurality of pores 242, through the bed of granules, through the second plurality of pores, and collects in the annulus 260 between the outer wall of the filter and the housing wall. In another aspect, some dust from the coarse solid particles also flows through the first plurality or pores and form a surface cake layer on the granular bed, which can prevent the coarse solid particles from penetrating deep into the granular bed. Thus, the bed rarely needs to be cleaned by a reverse flow of gas.

In one aspect of the pressure letdown device 200, the first pore diameter can be in the range from about 40 to about 150 microns. In another aspect, the second pore diameter can be in the range from about 40 to about 150 microns. The granules in the granular bed, in one aspect, have a mean diameter that can be greater than the first and second pore diameters.

Once the gas collected in the annulus 260 of the pressure letdown device reaches a predetermined pressure level, the gas egresses therethrough the gas outlet 290, thereby lowering the pressure in the pressure letdown device. The cooled coarse solid particles continue through the filter conduit 270 and exit the pressure letdown device via a solids outlet 310 positioned adjacent a distal end 300 of the filter conduit 270 at a lower pressure. In one aspect, the gas outlet can comprise a pressure regulating valve 294, although other methods of controlling the release of the gas from the pressure letdown device are contemplated. In one aspect, when the rate of solids discharged from the pressure letdown device is defined and constant, the gas outlet 290 comprises a gas outlet orifice with a diameter that can be varied depending on the particle properties and the total solids flow rate inside the filter conduit 270. In this aspect, the gas outlet 290 can be sized such that a velocity of gas in the outlet can be in the range of 30 to 100 feet per second. In another aspect, where the solids discharge rate and/or the process pressure varies, the pressure within the pressure letdown device can be controlled with the pressure regulating valve.

Figure 4:
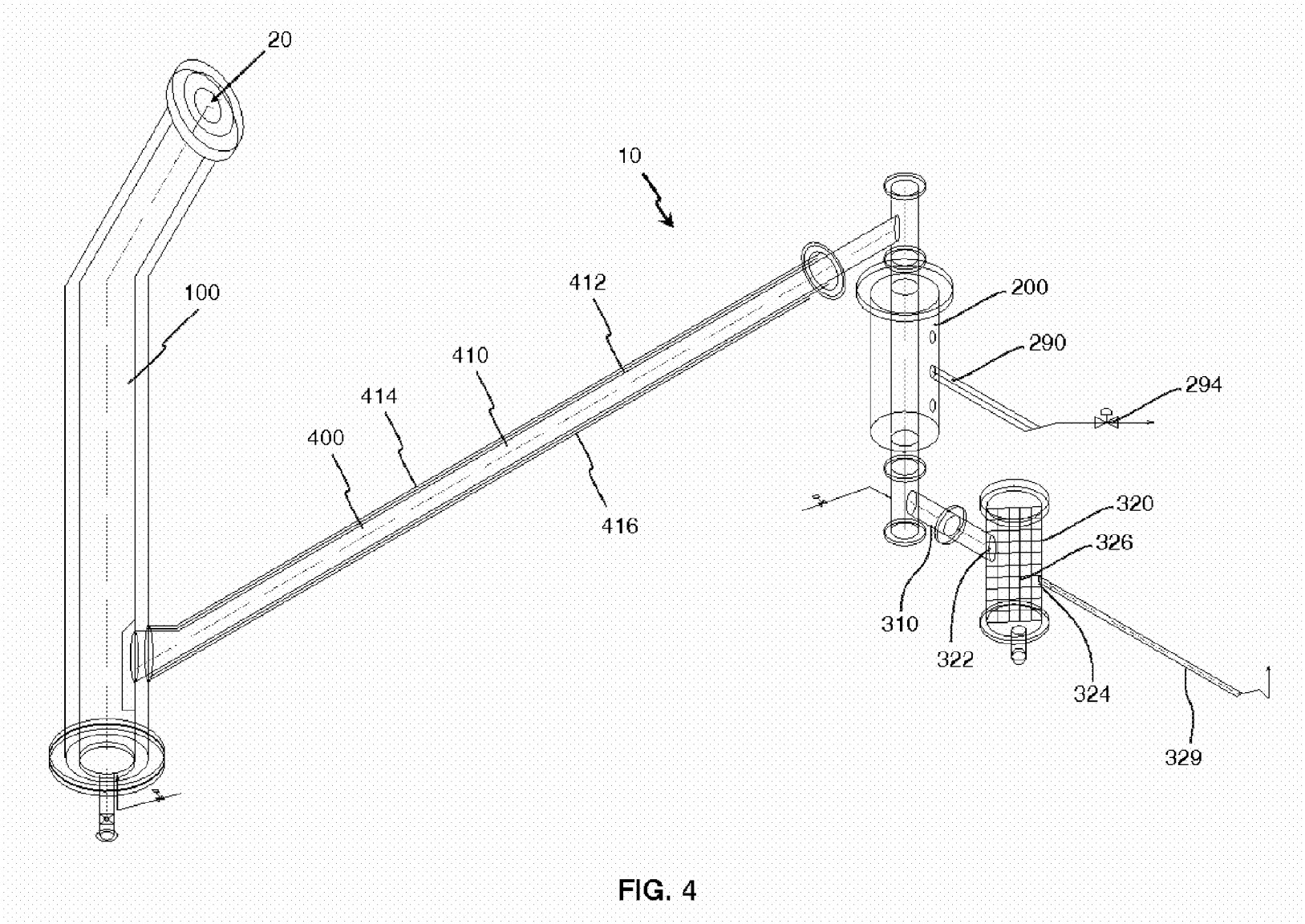
FIG. 4 is a schematic view of another embodiment of a depressurization system.
Figure 6:
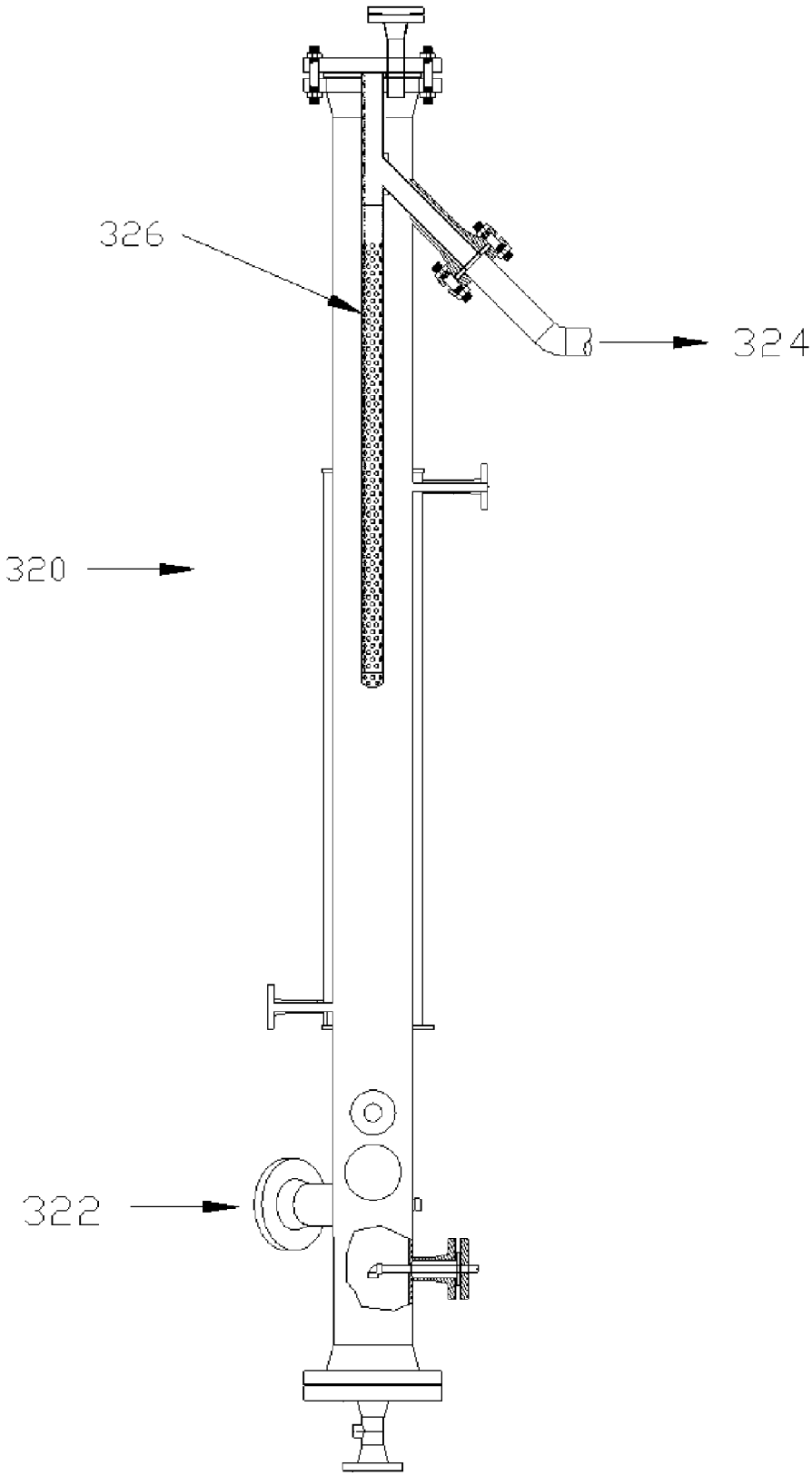
FIG. 6 is a schematic, partially cut-away view of a collector device of the depressurization system of FIG. 4, according to one aspect.

Additionally, in another aspect, the depressurization system 10 can comprise a collector device 320, as illustrated in FIGS. 4 and 6, comprising a coarse filter 326 in communication with the solids outlet 310 of the pressure letdown device 200. In one aspect, the collector device can prevent oversized solids and/or extraneous materials discharged from the solids outlet from potentially plugging a downstream conveying line. In another aspect, solids exiting the pressure letdown device via the solids outlet 310 can ingress a collector inlet 322. The coarse filter of the collector device can collect oversized solids and/or extraneous materials, removing them from the solids stream for disposal. The remaining solids can exit the collector device 320 via a collector outlet 324 in communication with the conveying line 329.

As mentioned herein above, the depressurization system, in one aspect, is part of a larger gasification or other commercial process system and is designed to depressurize and lower the temperature of the coarse solids particles from the high pressure, high temperature dense phase solids stream having gas entrained therein.

In an exemplary aspect, the coarse solid particles have a mean diameter from about 40 microns to about 1500 microns. In another aspect, the coarse solid particles have a mean diameter from about 40 microns to about 100 microns.

It is contemplated that the depressurization system can operate over a wide range of temperatures and pressures. In one aspect, high pressure, high temperature dense phase solids stream having gas entrained therein 20 can ingress the interior vessel cavity 114 at a pressure in the range from about 30 psig to about 1500 psig. In another aspect, the flow rate of the coarse solid particles into the vessel 100 can range up to 50,000 lbs/hr. After the high pressure, high temperature dense phase solids stream having gas entrained therein travels through the depressurization system 10, the coarse solid particles can egress the solids outlet 310 at a pressure in the range from about 0 psig to about 50 psig. In another aspect, the pressure of the coarse solids particles as they egress the solids outlet can vary, depending on the desired discharge rate and/or the conveying distance to a solids storage silo or disposal location. In another aspect, the high pressure, high temperature dense phase solids stream having gas entrained therein can ingress the vessel 100 at a temperature in the range from about 200 degrees Fahrenheit to about 2000 degrees Fahrenheit. After traveling through the depressurization system, according to one aspect, the coarse solid particles egress the solids outlet at substantially the same temperature as the gas released from the pressure letdown device. In one aspect, this temperature can be in the range of 200 degrees Fahrenheit to 850 degrees Fahrenheit. In another aspect, when the egress temperature at the solids outlet of the coarse solids is higher, the pressure letdown device can comprise an expansion joint 280 coupled to a lower portion of the inner wall 240 which is in contact with the high pressure, lower temperature dense phase solids stream entrained with gas 30.

In one aspect, wherein the solids flow rate varies, the rate of egress of solid particles from the solids outlet can be controlled by adjusting the pressure at the gas outlet 290 with the pressure regulating valve 294, as previously discussed. The size of the solids discharge line at the solids outlet can also have an impact on the rate of egress of the coarse solid particles. In another aspect, it is also contemplated that there can be a plurality of solids outlets. In yet another aspect, a conveying gas can be introduced adjacent the solids outlet to assist in the egress of the coarse solid particles. Additionally, the solids outlet 310 can also comprise a large solids filter and/or a collection system to prevent oversized solids or extraneous materials from being discharged from the solids outlet possibly plugging the line.

Should a larger drop in pressure be necessary, it is contemplated that a plurality of pressure letdown devices can be cascaded together in series, each having an outlet capable of removing gas. In one aspect, for example, in a process with an operating pressure of 650 psig and a solids removal rate of 50,000 lbs/hr, there can be 4 pressure letdown devices in series, each about 5 feet long.

In a large pilot facility installation where the depressurization system 10 has been tested, the solids flow rate is in the range 0 to 10,000 lbs/hr and the particle diameter is in the range 1 to 6000 microns with mean particle size ranging from 70 to 700 microns. The solids inlet temperature at the vessel inlet 110 is in the range 1600 degrees Fahrenheit to 1800 degrees Fahrenheit and the solids inlet pressure is in the range 200 psig to 275 psig. The solids discharge pressure has been varied from 5 psig to 40 psig in order to vary the solids discharge rate from 0 lbs/hr to 1000 lbs/hr, as desired. The solids discharge temperature ranges from 100 degrees Fahrenheit to 350 degrees Fahrenheit.

The depressurization system 10 can be used to process coarse solid particles from industrial applications. The system has been tested with process pressures varying up to 500 psig input into the vessel 100 for over 5,000 hours. High temperature coarse ash from the facility's gasifier operating up to 275 psig is withdrawn to a buffer volume. Potential clinkers and any other large pieces of extraneous material are separated from the coarse ash through a screening process. The coarse ash then flows as a moving packed bed through a horizontal column of a cooling apparatus 400 for initial depressurization. This horizontal column also acts as a double pipe heat exchanger. After initial depressurization and cooling in the horizontal column, the ash flows through a pressure letdown device 200 for further depressurization. The depressurized coarse ash is further cooled in the collector device 320 and discharged to an ash silo through a conveying line 329. The system has been fully integrated with the gasification process and the solids level in the gasifier has been maintained within a narrow range by varying the discharge rates of coarse solids through the depressurization system 10. The depressurization system has been successfully operated with coarse materials derived from lignite, subbituminous coal and bituminous coal.

In one aspect, multiple trains of depressurization system can be coupled together. In another aspect, each train can have coarse ash handling capacity of 36,000 lbs/hr, ranging up to 50,000 lbs/hr. In this aspect, the depressurization system can be operated at pressures up to 650 psig and inlet temperature up to 1850 degrees Fahrenheit. The coarse ash can be cooled in a solids cooler and then depressurized through a horizontal column and multiple stages of a pressure letdown device before being discharged to an atmospheric ash silo for storage and disposal.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

The invention claimed is:

1. A depressurization system in fluid communication with a high pressure, high temperature dense phase solids stream having coarse solid particles with entrained gas therein, the system comprising:

a means for cooling the high pressure, high temperature dense phase solids stream having coarse solid particles with entrained gas therein to a lower temperature to form a high pressure, lower temperature dense phase solids stream having coarse solid particles with entrained gas therein;

a pressure letdown device configured to at least partially depressurize and separate the coarse solid particles from the high pressure, lower temperature dense phase solids stream having coarse solid particles with entrained gas therein, comprising:

a housing defining an interior separator cavity and having a housing wall;

a plurality of granules configured to form a granular filter bed;

a filter disposed within the interior separator cavity and having an inner wall and a spaced outer wall, the outer wall being spaced therefrom the housing wall and defining an enclosed annulus between the filter and the housing wall, wherein the inner wall defines a filter conduit in fluid communication with the high pressure, lower temperature dense phase solids stream, the inner wall comprising a first plurality of pores having a first pore diameter that is greater than a mean diameter of the coarse solid particles, wherein the outer wall comprises a second plurality of pores having a second pore diameter that is less than a mean diameter of the granules of the granular filter bed, wherein the inner wall and the outer wall of the filter define an enclosed filtration cavity, and wherein the bed of granules is disposed therein the filtration cavity; and a gas outlet in selective fluid communication with the annulus configured for egress of at least partially depressurized gas;

wherein a distal end of the filter conduit forms a solids outlet configured for egress of the coarse solid particles.

2. The depressurization system of claim 1, wherein the means for cooling comprises:

a thermally conductive elongate cooling conduit in fluid communication with the high pressure, high temperature dense phase solids stream having coarse solid particles with entrained gas therein, wherein the coarse solid particles have a dimension smaller than a predetermined dimension and the filter conduit, and wherein at least a portion of the elongate cooling conduit is in thermal communication with a coolant source.

3. The depressurization system of claim 2, further comprising:

a vessel having an upper portion and an opposed lower portion and defining an interior vessel cavity, the vessel comprising:

a vessel inlet defined therein the upper portion of the vessel that is in selective fluid communication with the high pressure, high temperature dense phase solids stream having coarse solid particles with entrained gas therein;

a vessel outlet defined therein a lower portion of the vessel in communication with the vessel cavity; and a screen positioned therein the vessel cavity and substantially enveloping the vessel outlet, wherein the screen defines a plurality of screen openings having a dimension substantially equal to the predetermined distance, the screen configured to prevent passage of particles with a dimension larger than the predetermined dimension of the screen openings;

wherein the vessel outlet is configured for passage of the high pressure, high temperature dense phase solids stream having coarse solid particles with entrained gas therein.

4. The depressurization system of claim 3, wherein at least a portion of the screen is configured to deflect particles and extraneous materials having a dimension larger than the predetermined dimension of the screen openings toward the lower portion of the vessel.

5. The depressurization system of claim 2, wherein a moving packed bed column of solids stream can be formed therein the elongate cooling conduit configured to at least partially depressurize the high pressure, high temperature dense phase solids stream having coarse solid particles with entrained gas therein.

6. The depressurization system of claim 5, wherein in the elongate cooling conduit, gas flows faster than solids thereby inducing a pressure reduction.

7. The depressurization system of claim 5, wherein in the moving packed bed column of solids stream, friction between the particles and an inner wall of the elongate cooling conduit reduces the amount of gas to be separated from the solids in the pressure letdown device.

8. The depressurization system of claim 5, wherein the moving packed bed column of solids stream is further configured as a heat exchanger to at least partially lower the temperature of the dense phase solids stream having coarse solid particles with entrained gas therein to a desired temperature.

9. The depressurization system of claim 1, wherein the granules of the granular filter bed have a mean diameter such that voids in the bed are smaller than the mean diameter of the coarse solid particles.

10. The depressurization system of claim 1, wherein the pressure letdown device comprises an expansion joint coupled to the inner wall of the filter conduit.

11. The depressurization system of claim 10, wherein the pressure letdown device is configured to depressurize the high pressure, lower temperature dense phase solids stream having coarse solid particles with entrained gas therein having a temperature of 850 degrees Fahrenheit and below.

12. The depressurization system of claim 1, wherein the gas outlet comprises an outlet orifice to regulate the pressure and flow rate of the at least partially depressurized gas.

13. The depressurization system of claim 1, wherein the gas outlet comprises a pressure regulating valve to regulate the pressure and flow rate of the at least partially depressurized gas.

14. The depressurization system of claim 13, wherein a solids discharge pressure and a solids discharge rate can be varied by varying a pressure setpoint on the pressure regulating valve of the gas outlet.

15. The depressurization system of claim 1, further comprising a collector device in communication with the solids outlet and configured to prevent materials passing therethrough the solids outlet having a dimension greater than a second predetermined dimension from passing therethrough the collector device.

16. The depressurization system of claim 2, wherein the cooling conduit comprises an inner pipe and a spaced outer pipe defining a coolant pathway therebetween, and wherein the coolant pathway is in fluid communication with the coolant source.

17. The depressurization system of claim 3, wherein at least a portion of a heat exchange surface is positioned therein the vessel cavity, the heat exchanger surface configured for lowering the temperature of the high pressure, high temperature dense phase solids stream having coarse solid particles with entrained gas therein.

18. The depressurization system of claim 3, further comprising a secondary outlet in communication with a portion of the lower portion of the vessel for selective removal of the particles with a dimension larger than the predetermined dimension.

19. The depressurization system of claim 3, wherein a portion of the screen is spaced therefrom the vessel outlet defining a screen cavity in communication with the vessel outlet.

20. The depressurization system of claim 19, wherein at least a portion of the screen cavity is in fluid communication with a pressurized fluid source.

21. The depressurization system of claim 3, wherein the high pressure, high temperature dense phase solids stream having coarse solid particles with entrained gas therein ingresses the vessel at a pressure in the range from about 30 psig to about 1500 psig.

22. The depressurization system of claim 21, wherein the coarse solid particles egress the solids outlet at a pressure in the range from about 0 psig to about 50 psig.

23. The depressurization system of claim 3, wherein the high pressure, high temperature dense phase solids stream having coarse solid particles with entrained gas therein ingresses the vessel at a temperature in the range from about 1000 degrees Fahrenheit to about 2000 degrees Fahrenheit.

24. The depressurization system of claim 23, wherein the coarse solid particles egress the solids outlet at a temperature in the range from about 100 degrees Fahrenheit to about 350 degrees Fahrenheit.

25. The depressurization system of claim 1, wherein the coarse solid particles discharge rate from the solids outlet is in the range from 0 lbs/hr to about 50,000 lbs/hr.

26. The depressurization system of claim 1, wherein the coarse solid particles have a mean diameter from about 40 microns to about 1500 microns.

27. The depressurization system of claim 1, wherein the pressure letdown device comprises a plurality of pressure letdown device in series with one another.

28. The depressurization system of claim 3, wherein the high pressure, high temperature dense phase solids stream having coarse solid particles with entrained gas therein ingresses the vessel at a temperature in the range from about 200 degrees Fahrenheit to about 2000 degrees Fahrenheit.

29. The depressurization system of claim 28, wherein the coarse solid particles egress the solids outlet at a temperature in the range from about 100 degrees Fahrenheit to about 350 degrees Fahrenheit.

* * * * *